United States Patent [19]

Meier et al.

[11] Patent Number: 5,019,716

[45] Date of Patent: May 28, 1991

[54] INSERTION SYSTEM FOR PRINTED PRODUCTS

[75] Inventors: Jacques Meier, Bäretswil; Werner Honegger, Tann Rüti, both of Switzerland

[73] Assignee: Ferag AG, Hinwil, Switzerland

[21] Appl. No.: 350,308

[22] Filed: May 5, 1989

[30] Foreign Application Priority Data

May 25, 1988 [CH] Switzerland ..... 1975/88

[51] Int. Cl.[5] ..... B65H 5/30

[52] U.S. Cl. ..... 270/55; 270/54

[58] Field of Search ..... 270/54, 55, 57, 58

[56] References Cited

U.S. PATENT DOCUMENTS

| | | | |
|---|---|---|---|
| 3,951,399 | 4/1976 | Reist | 270/58 |
| 3,955,667 | 5/1976 | Müller et al. | 198/180 |
| 4,039,182 | 8/1977 | Reist et al. | 271/64 |
| 4,072,228 | 2/1978 | Honegger et al. | 198/459 |
| 4,201,286 | 5/1980 | Meier | 198/461 |
| 4,381,056 | 4/1983 | Eberle | 198/696 |
| 4,445,681 | 5/1984 | Reist | 271/300 |
| 4,471,953 | 9/1984 | Reist et al. | 270/54 |
| 4,525,982 | 7/1985 | Meier | 53/430 |
| 4,575,988 | 3/1986 | Meier | 53/399 |
| 4,706,951 | 11/1987 | Leu | 270/55 |
| 4,709,910 | 12/1987 | Honegger | 270/55 |

*Primary Examiner*—John T. Kwon
*Assistant Examiner*—Therese M. Newholm
*Attorney, Agent, or Firm*—Walter C. Farley

[57] ABSTRACT

An insertion system contains a cell wheel, which contains a plurality of feed sections (13) and at least two intake sections (12*a*, 12*b*) for the supply of main printed products. The intake sections (12*a*, 12*b*) are axially spaced apart. The system also has a feed means (17) with branches (40) and switchable sorting gates (50–56). On the outlet side is provided a distributor (18) with branched and switchable conveying sections (5) and removal stations (6).

Main products are conveyed to intake sections (12*a*, 12*b*) and preproducts from the feed sections (13) are inserted into the main products. By appropriately setting the sorting gates (50–56) or branches (40), it is possible to compile approximately 80,000 end products per hour in a flexible manner. The inventive method also permits the complication of much more comprehensive end products with a very high process speed. It is also possible to simultaneously bring together different end products through the insertion system.

12 Claims, 4 Drawing Sheets

INSERTION SYSTEM FOR PRINTED PRODUCTS

The invention relates to a method and an apparatus for inserting printed products, particularly newspaper preprints or supplements, in a main product, as well as to an insertion system for performing the method.

BACKGROUND OF THE INVENTION

On comparing the working speeds of conventional insertion apparatuses and those of conventional newspaper printing presses, which nowadays have a capacity of approximately 70,000 and more newspapers per hour, it can be seen that the latter speeds are nowhere near reached. In order to be able to utilize this high capacity of printing presses in connection with the insertion of the individual printed product units, it is necessary for the insertion system to have a correspondingly high working speed. Achieving such a high speed is made difficult by the fact that nowadays the printed products are very large, e.g. having 200 or more pages, and that a single insertion process requires a minimum working or processing time.

Conventional insertion apparatuses reach maximum working speeds of roughly ten to a maximum of forty thousand printed products per hour. Attempts have been made to increase the working speed and adaptability of such equipment, but the known solutions lead to other disadvantages limiting practical use.

Swiss Patent 659 642 (U.S. Pat. No. 4,477,067) discloses an apparatus for compiling newspapers which is designed according to the merry-go-round principle. This apparatus has a rotary platform with reception compartments and a plurality of stationary feed stations arranged in a circle, in which n (n being conventionally 2) feed stations are supplied with cover or wrapping sheets and in-feed stations with insert sheets. Therefore each station only has to feed every n th, i.e. every second, reception compartment, so that the rotary platform can rotate more rapidly than the corresponding merry-go-round principle devices. However, in principle, such apparatuses with a rotary platform or similar rotary systems suffer from the disadvantage that the feed channels to the feed stations lead away radially from the rotary platform and the complete installation takes up a large amount of space. Moreover, only a limited number of reception compartments can be arranged around the rotary platform circumference, so that there is a limitation to a few units of the printed product units which can be simultaneously inserted into the cover sheet or newspaper jacket. As can be gathered from the aforementioned patent, with working speeds of 40,000 per hour only one cover sheet and six insert sheets can be compiled, while at a speed of 80,000 per hour only one cover sheet and two insert sheets can be compiled. The working speed is related to the end product, i.e. there are 40,000 complete end products with inserted supplements per hour at the discharge point. Thus, in the case of such apparatuses, the higher working speed is bought at the cost of the number of insertable units. Therefore such an apparatus is only suitable for printed products with limited numbers and also, due to the large space requirement, only for special uses.

Obviously attempts have also been made to functionally arrange in parallel several insertion apparatuses but this, apart from the additional space requirement, leads to much greater mechanical expenditure and, therefore, to high costs.

The processing of printed products by means of a cell wheel (insertion drum), namely the insertion of supplements into folded printed products, or the compilation of partial products to form a complete product is e.g. known from Swiss patents 584 153 (U.S. Pat. No. 3,951,399), 649 267 (U.S. Pat. No. 4,416,448) and 575 303 (U.S. Pat. No. 4,058,202). Apart from the limited output of printed products, such apparatuses can only be used to a limited extent for the compilation of large end products. In order to increase the working speed of the apparatus, Swiss Patent 649 267 (U.S. Pat. No. 4,416,448) proposes that two printed products jointly traverse the processing or working path. This obviously increases the speed of the insertion process, but additional components and means are required in order to ensure operationally reliable insertion. There are also only limited possibilities for inserting a plurality of inserts or printed product units, particularly if different insertion combinations are to be obtained. Also in the case of this apparatus, the scope of the end product is limited to a relatively small number of pages.

SUMMARY OF THE INVENTION

An object of the present invention is to provide an insertion system which has a high processing or working speed and relatively limited space requirements, which can receive large printed products, permits high flexibility of the insertion possibilities and combinations and which can be integrated in the sense of a modular partial system into an automatic production sequence.

Briefly described, the invention includes an apparatus for compiling at least two printed product parts with a rotating cell wheel having an intake section for the cover part and feed sections for the preproducts as well as a conveying means for conveying the printed product parts along a processing path. At least one device is provided for opening the printed product parts during their conveying. The cell wheel is constructed as an insertion drum with a plurality of feed sections and has at least one second intake section for the cover part, which is axially displaced from the first intake section.

BRIEF DESCRIPTION OF THE DRAWINGS

Embodiments of the invention are described in greater detail hereinafter relative to the drawings, wherein.

DESCRIPTION OF THE PREFERRED EMBODIMENTS

The principal object of the invention is the creation of an insertion system, which can inter alia be integrated in the sense of a modular partial system into an automatic production sequence. It is borne in mind in this connection that in the production of printed products continuous processes often take place at very high speeds and which optimally, should at least approximately reach the working speed of the printing press. Thus, in other words, it must be possible to compile parts of a printed product, e.g. the cover or title page of a newspaper directly from the rotary press with preproducts, the latter being inserted at the same operating speed as the printing press. Despite the high speed required, the insertion process must be flexible. For example, it must be possible to compile an end product selectably containing different parts, e.g. different regional parts.

The insertion system is particularly suitable for inserting at least one, but normally several, preproducts into a folded main product. In this context, the term "main product" is understood to mean all folded printed products which are intended to form the cover or wrapper of the end product. For example, in the case of newspapers this is the topical part printed chronologically immediately prior to publication, or in the case of catalogues or brochures the first and last pages. The term "preproduct" is understood to mean all products intended to be inserted in the main product, or into preproducts already introduced into the latter. These preproducts obviously include printed products, but also flat enclosures of all types. The main product combined with the preproduct or with several different preproducts consequently forms the end product.

According to the invention the insertion system is constructed in such a way that printed product parts can be supplied at high speed from a plurality of conveying sections and are then flexibly brought together by the system. The processing capacity for limited space requirements must be so large that it is possible to compile very large end products. The inventive concept is based on the fact that the nucleus of the insertion system is an insertion drum with an increased number of feed sections in the axial direction compared with conventional cell wheels and in particular with at least two feed sections for the main products. In addition, control and conveying means are provided which optionally compile or insert into one another the printed products parts supplied to the individual feed sections and, by means of a distributor, feed those to the insertion system outlet.

Figure 1:
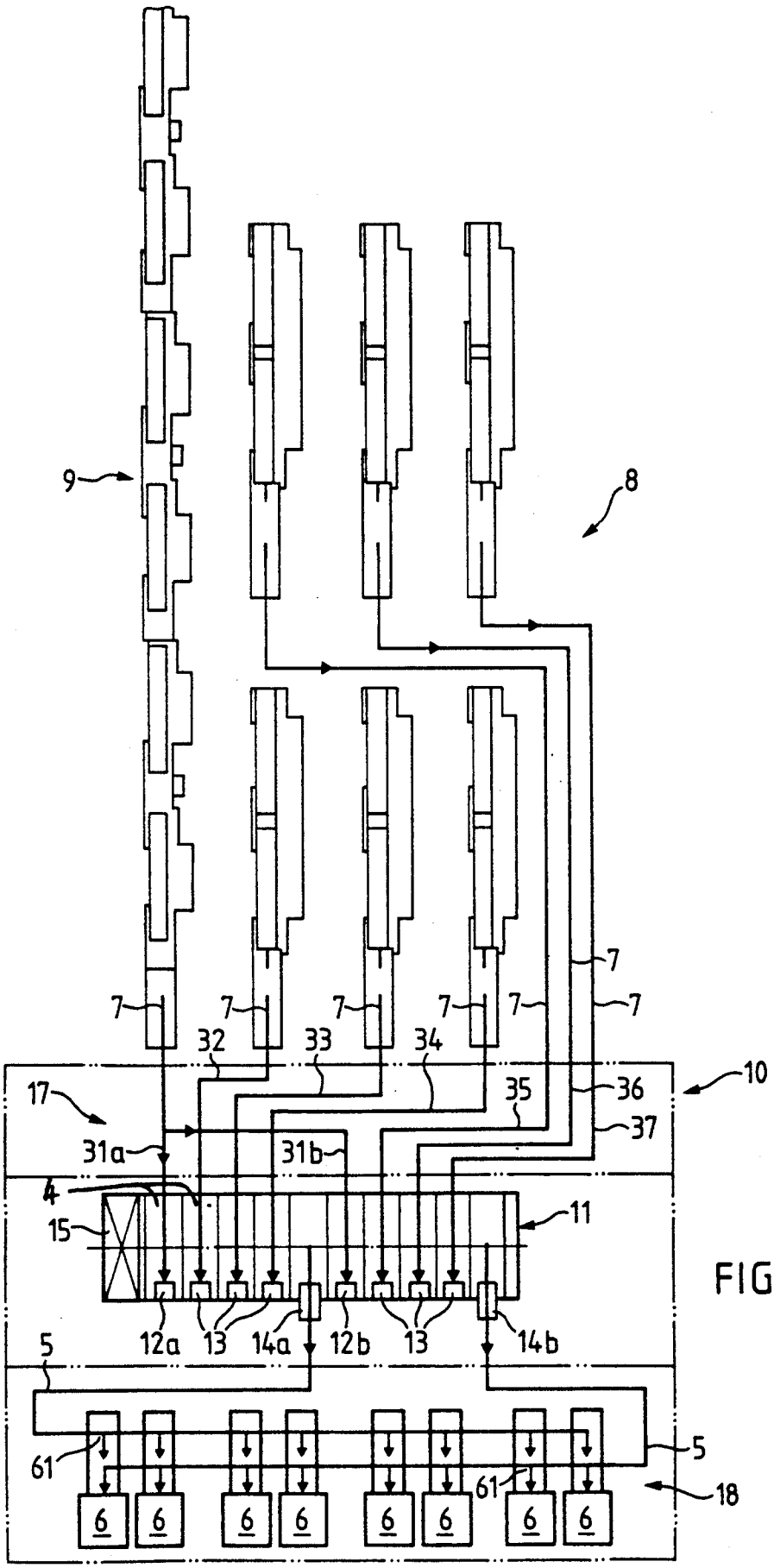
FIG. 1 is a schematic diagram of a printing installation with an inventive insertion system.

FIG. 1 diagrammatically shows a possible arrangement of a buffer system 9 and several winding stations 8, such as are known e.g. from Swiss Patent Applications 860/87-5 (which corresponds to U.S. Ser. No. 288,942 filed Dec. 23, 1988) and 580/88-6. Upstream of the buffer system 9 (i.e., at the top of the drawing) is provided a rotary press not shown in the drawing. Each of the winding stations 8 and buffer system 9 have an outlet-side conveying means 7, which can be constructed in known manner e.g. as a conveyor belt or other type of conveyor and are connected by the conveying means to the insertion system 10. The essentially free-part insertion system contains an inlet-side feed means 17, an insertion drum 11 and an outlet-side distributor 18. The insertion drum 11 has a diagrammatically shown, motor-operated drive 15, feed sections 13 and two removal or unloading sections 14*a*, 14*b*.

In this embodiment the feed means has a very simple construction and connects the conveying means 7 of winding stations 8 via conveying sections 4 (FIG. 3) to the feed sections 13. Only the conveying means 7 of the buffer system 9 is branched and connected to two different feed sections 13. The feed means 17 consequently has eight feeds 31*a*, 31*b* and 32–37 to the insertion drum.

The feeds 31–37 to the insertion drum 11 are preferably parallel to one another and at right angles to the drum axis, so that the conveying sections 4 (FIG. 3) or conveying means 7 can be arranged in a space-saving manner. The insertion system 10 can be simply introduced into existing installations, because the flexible, inlet-side feed concept offers a problem-free interface. If there is a direct supply from the rotary press, then this can be subdivided on the inlet-side into two feed sections 31*a*, 31*b*, so that each feed section numerically only has to take up half of the supplied product parts.

Also the outlet-side distributor comprises, in the embodiment according to FIG. 1, a relatively simple arrangement with eight removal stations 6. The removal sections 14*a*, 14*b* of insertion drum 11 are connected by means of two conveying sections 5 to, in each case, one of these removal stations. Each of the conveying sections 5 is connected by a sorting gate 61 to the removal station. The desired positions of the sorting stations 61 can be predetermined or also modified during the process, e.g. in the case of one of the removal stations 6 dropping out.

The feed means 17 and distributor 18 are considered here as a simple arrangement, because in this embodiment they only have fixed connections or limited switching possibilities. As will be shown hereinafter, said means 17 and 18 preferably have additional sorting gates and adjustment possibilities, which permit different connection possibilities and consequently enable the system to be used in a flexible manner.

Conventionally the cover or front page of a newspaper is printed just prior to the final compilation of the newspaper, so that the front page has maximum topicality. In the installation according to FIG. 1, e.g. the conveying means 7 supplies the buffer system 9 with the freshly printed cover parts or pages at a speed of 80,000 units per hour.

As a result of the known limit conditions for insertion (limited circumferential speed of the insertion drum, necessary operating time during insertion), the product flow is subdivided in the feed means and fed to two different intake sections 12*a*, 12*b* (FIG. 3) of the insertion drum. Thus, there are only 40,000 units per hour per intake section. The preproducts are supplied at a corresponding speed from winding station 8 by means of feeds 32–37. To facilitate understanding, in connection with the feeds for the cover parts, reference is made to "intake sections". It is readily apparent that there need fundamentally be no difference between the intake sections for the cover pages and the feed sections for the preproducts. Thus, intake sections 12*a*, 12*b* can equally well supply preproducts and in a downstream feed section can be inserted into the cover part supplied there.

Figure 2:
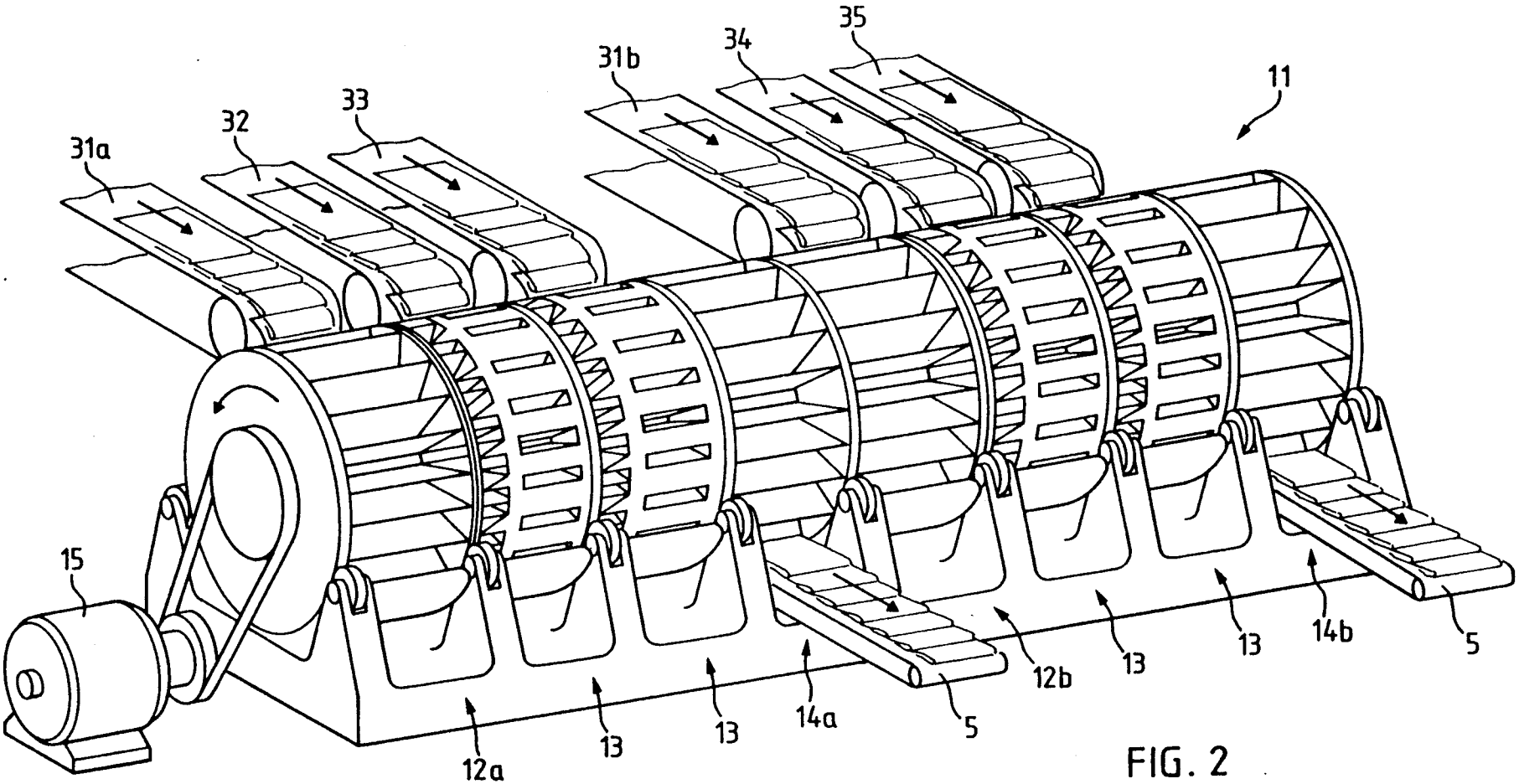
FIG. 2 is a simplified perspective view of an insertion drum in accordance with the inventive insertion system.

FIG. 2 shows an embodiment of the insertion drum 11 with two intake sections 12*a*,12*b*, four feed sections 13 and two removal sections 14*a*,14*b*. The rotation of the insertion drum 11 is brought about by drive 15. Feeds 31–35 and conveying sections 5 are constructed here as conveyor belts. It is possible to use clip or clamp conveyors or other means. Further details concerning the operation and construction of an insertion drum can be gathered from Swiss Patent 649 267 (U.S. Pat. No. 4,416,448) which is hereby incorporated by reference. As can be gathered from the drawings, by means of feeds 31*a*, 31*b*, it is simultaneously possible to supply either identical or different main products. By means of feeds 32, 33, it is possible to insert preproducts into the main product supplied by feed 31*a* and correspondingly by means of feeds 34, 35, preproducts can be inserted in the main products supplied by feed 31*b*. In another operating mode, it is possible to leave the first removal section 5 passive, i.e. no end products are removed there. The main products with two inserted preproducts from feeds 32, 33 are passed without any change to this removal section and subsequently further preproducts can be inserted by means of feeds 31b, 34 and 35. It is apparent that for this operating procedure the second intake sections 31b must be constructed in the same way as feed sections 32–35. This makes it possible using the same apparatus to insert five preproducts into one main product and to remove the end product by means of the second, active removal section 11.

Figure 3:
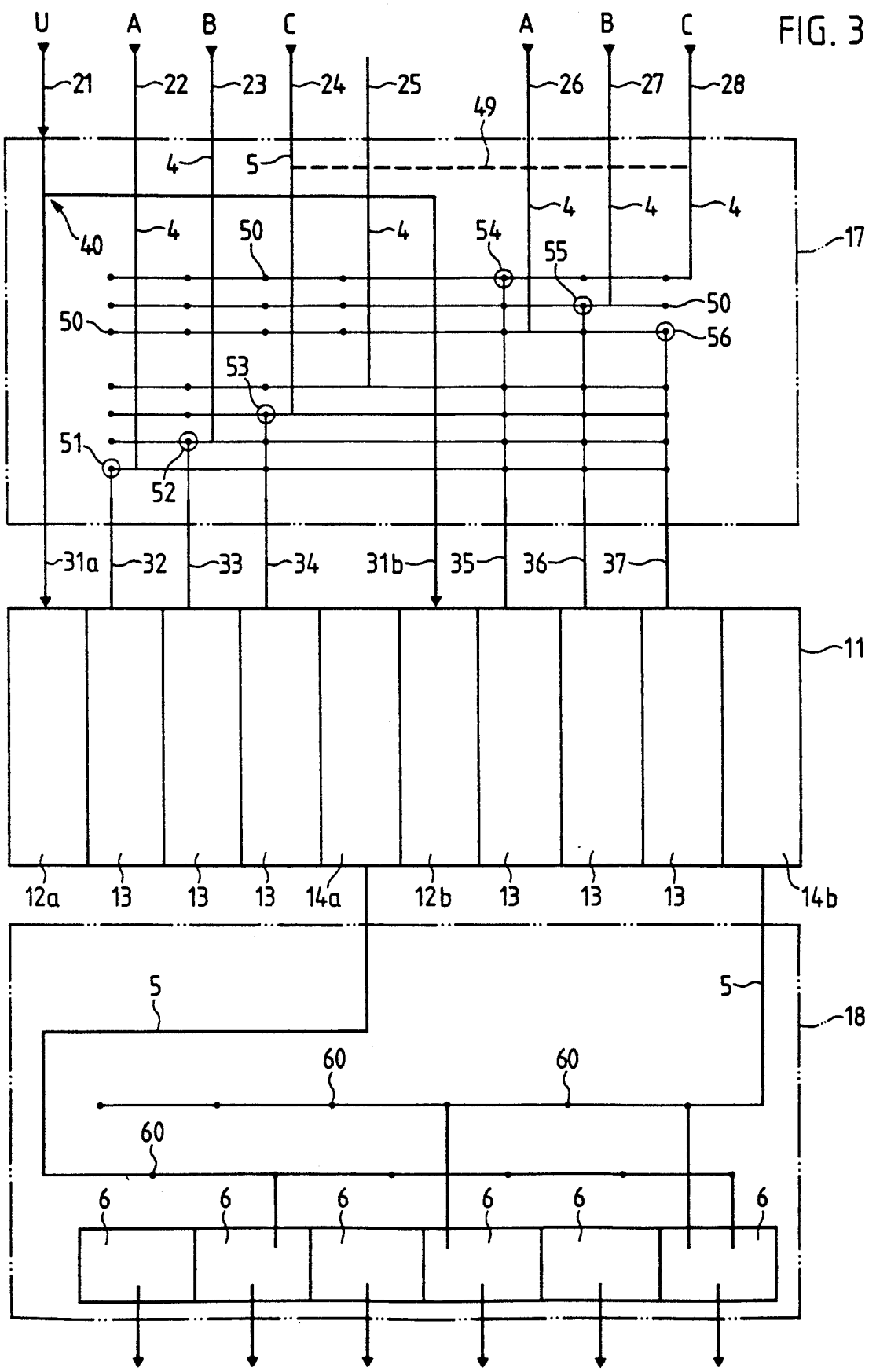
FIG. 3 is a flow diagram of the inventive method.

FIG. 3 is a diagram of the insertion system, which illustrates its flexibility and also the method according to the invention. It must be borne in mind that this diagram does not reflect a spatial arrangement of the apparatus components and only illustrates one of several possible arrangements. It is possible to see three areas of the insertion system, namely the feed means 17, the insertion drum 11 and the distributor 18. In order to make understanding of the drawing easier, all parts not essential for the method are either not shown, or are only diagrammatically represented. A plurality of feed conveying means 21–28 for feeding printed product parts, i.e. the main products (cover pages) and preproducts is connected to the feed means 17. The latter forms the interface to the insertion drum 11 and permits a random connection between the feed means 21–28 and the previously explained feeds 31a, 31b and 32–37 to the insertion drum 11.

The feed means can either contain fixed feed sections 4 between the conveying means 21–28 and feeds 31–37, or, preferably, as shown in FIG. 3, switchable connections 50 (only three of these being shown) in the conveying sections 4 within the feed means. The main product is supplied by means of conveying means 21, which has a non-switchable branch 40 and which is connected to two separate feeds 31a and 31b. It is obviously possible to provide further branches within the feed means 17, which make it possible to subdivide the product flow supplied by the conveying means 21–28 and to feed same to two or more separate feeds 31–37. A possible branching section 49 between the two conveying means 24 and 28 is shown for illustration purposes. This branching section makes it possible to subdivide the product flow of conveying means 24 and/or conveying means 28.

In the represented embodiment, feeds 31–37 are connected to the conveying means 21–28 via the connections designated by reference numerals 51–56 and marked by circles. These switchable connections 50–56 make it possible to produce a variety of different connections between the conveying means 21–28 and feeds 31–37 and therefore to influence the arrangement of the inserted printed product parts. For illustration purposes it is assumed that a cover part U is supplied via conveying section 21 and preproducts A–C by in each case one of the conveying means 22–24 and 26–28. If the printed product parts in insertion drum 11 supplied by feeds 31–37 are successively inserted in the cover part U, then in the end product, which is removed via the first removal section 14a, the individual parts are arranged in order A-B-C, but in order C-B-A in the second removal section 14b. Thus, in other words, it is possible by switching the connections 50–56, to obtain random permutations of the printed product part supplied, the desired arrangement being achieved by a planned switching of connections 50–56. The inventive feed means even makes it possible to vary the connections during the insertion process, so that in the same installation and without changing the rolls in the winding station, different end products can be compiled. The more flexible the possibility in the conveying means 21–28, i.e. to the extent that it is simply possible to feed the printed product parts to a random conveying means, the less the flexibility which is required for the feed means 17. If the permutation of the printed product parts e.g. agrees on the intake side, then in place of switchable connections, fixed conveying sections can be provided between the conveying means 21–28 and the feed sections 31–37.

As a result of corresponding branching of several conveying sections 4, it is possible to compile at a high speed both the cover part and also different preproducts. It is possible to make the sorting gates 50–56 such that they can also bring about the necessary branches.

The distributor contains conveying sections 5 by means of which it is possible to remove the end products from removal sections 14a, 14b. These conveying sections preferably have a plurality of sorting gates 60 (only three being indicated in the drawing), by means of which random connections can be formed with one or more removal stations 6. The removal stations are preferably constructed in such a way that they can be simultaneously connected to two or more removal sections 14, so that the end products can be removed from said sections via the same removal station 6. It is obviously also possible to provide fixed branches in said conveying sections 5.

Figure 4:
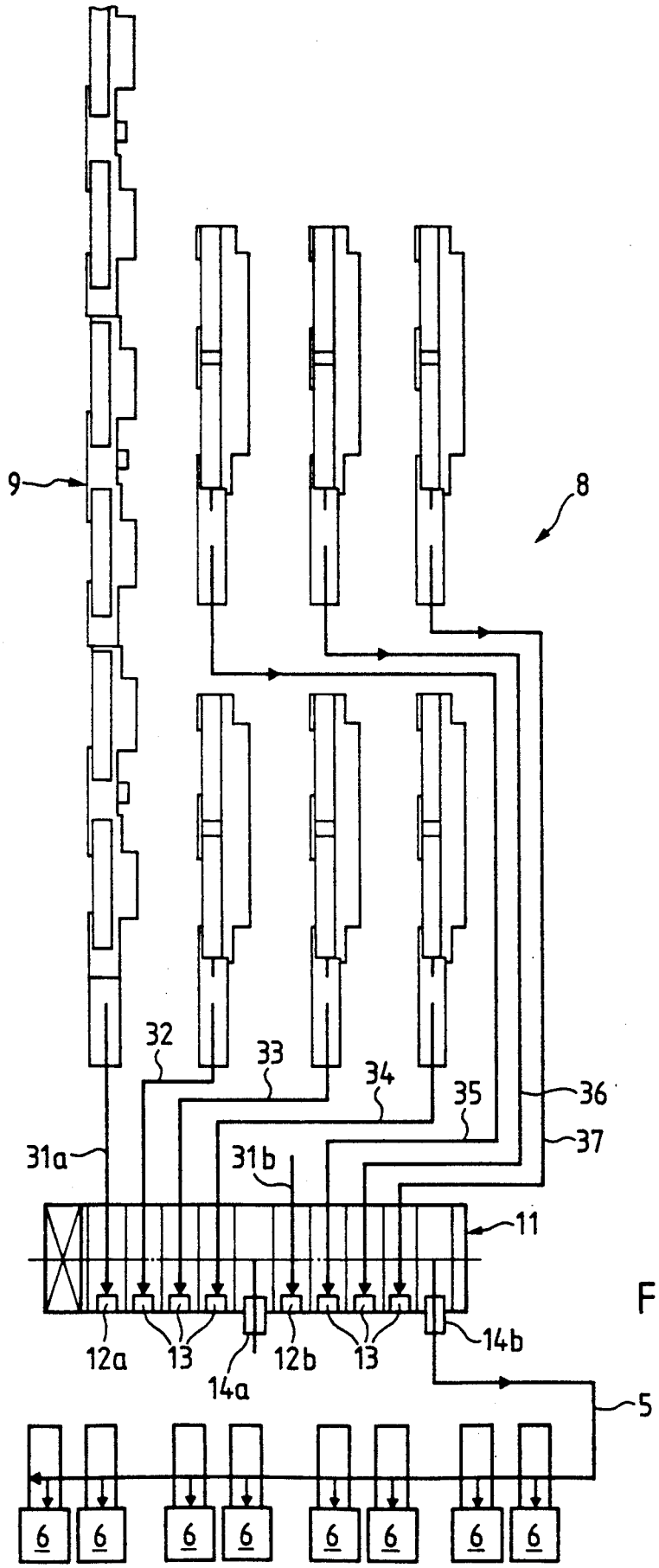
FIG. 4 is a schematic diagram of the embodiment of FIG. 1 in a different operating mode.

FIG. 4 shows an insertion system according to FIG. 1 in another operating mode. The reference numerals have been retained, so that reference can be made to the corresponding construction in FIG. 1. As can be gathered from FIG. 4, the feed 31b used for supplying the main product is free or can be connected to winding stations in order to supply preproducts therefrom. The main products are provided via the feed 31a and in this mode up to seven preproducts can be inserted via feeds 32–37 and, if necessary, 31b. Removal section 14a is passive and the end products are only removed at the second removal section 14b and supplied via conveying section 5 to removal stations 6.

Preferably there are the same number of removal sections 14a, 14b for the end products, as there are intake sections 12a, 12b. In the most standard use identical main products are supplied via the intake sections and the corresponding end products are removed with the inserted preproducts at, in each case the "associated" removal sections. In the case of special uses, there can also be differences in the numbers of intake and removal sections.

The term "insertion" used within the scope of the present specification is to be understood in its widest sense. It in particular covers variations in which the printed product parts are only brought together, e.g. superimposed and which are subsequently, in an additional operation inserted in a cover part. For example, in the variant according to FIG. 1, initially several preprints supplied by means of feeds 31–33 can be inserted in one another or superimposed and placed in a cover part conveyed by means of feed 34.

For very large systems the possibility exists of further extending the insertion drum, or to supply the system with printed products simultaneously from more than one printing press.

We claim:

1. An insertion system for handling and assembling main products and preproducts to form end products comprising the combination of an insertion drum having a plurality of rotatable, axially spaced product receiving sections for receiving product parts, a plurality of rotatable insertion sections between each pair of said product receiving sections, means for axially transferring products from section to section, and means for removing assembled end products from said insertion drum;

means defining a plurality of inlet locations for receiving main products and preproducts;

feed means for delivering main products and preproducts to at least one of said product receiving sections and to said insertion sections, said feed means including a plurality of switchable paths between said inlet area and said insertion drum so that products from any of a plurality of inlet locations can be selectively directed to different ones of said product receiving and insertion sections; and a distributor portion including means defining a plurality of removal stations; and outlet conveyor means for conveying end products from said insertion drum to said removal stations.

2. An insertion system according to claim 1 wherein said conveyor means includes a plurality of switchable paths so that said end products can be selectively directed to different ones of said removal stations.

3. An insertion system according to claim 2 wherein said feed means includes a main product feed conveyor having at least one branch forming at least two conveyor paths delivering main product to at least two product receiving sections.

4. An insertion system according to claim 3 wherein said feed means includes at least one preproduct conveyor including a sorting gate for selectively delivering preproduct from a selected inlet location to any of said product receiving and insertion sections.

5. An insertion system according to claim 4 wherein said preproduct conveyors are substantially parallel with each other.

6. An insertion system according to claim 1 wherein said feed means includes a main product feed conveyor having at least one branch forming at least two conveyor paths delivering main product to at least two product receiving sections.

7. An insertion system according to claim 6 wherein said feed means includes at least one preproduct conveyor including a sorting gate for selectively delivering preproduct from a selected inlet location to any of said product receiving and insertion sections.

8. An insertion system according to claim 7 wherein said preproduct conveyors are substantially parallel with each other.

9. A method for inserting a plurality of printed preproducts into main products comprising the steps of establishing switchable conveying paths having sorting gates between a plurality of inlet locations and a plurality of receiving and insertion sections in an insertion drum so that main products and preproducts from the inlet locations can be delivered to selected ones of the receiving and insertion sections, feeding main products and preproducts to the selected sections of the insertion drum in accordance with the sorting gate selections, assembling the main products and preproducts into end products in the insertion drum, removing the end products from the insertion drum, and establishing a second plurality conveying paths for delivery of the removed end products to selected end locations.

10. A method according to claim 9 wherein the second plurality of conveying paths include sorting gates and wherein the step of establishing the second plurality of paths includes the step of switching the sorting gates to select the delivery of end products to selected end locations.

11. A method according to claim 10 wherein the insertion drum includes an axial array of at least two intake sections each followed downstream by insertion and removal sections and wherein, during assembly of the main products and preproducts, the main products are delivered to the first intake section and are moved axially through a plurality of insertion sections of the insertion drum at which preproducts are inserted and past the first removal section and are removed by the most downstream removal section.

12. A method according to claim 10 wherein the insertion drum includes an axial array of at least two intake sections each followed downstream by insertion and removal sections and wherein, during assembly of the main products and preproducts, the main products are delivered to the first intake section and are moved axially through a plurality of insertion sections of the insertion drum at which preproducts are inserted and past the first removal section and are removed by a removal section further downstream.

* * * * *